US011359617B2

(12) United States Patent
Lee et al.

(10) Patent No.: US 11,359,617 B2
(45) Date of Patent: Jun. 14, 2022

(54) COMPRESSOR

(71) Applicant: LG ELECTRONICS INC., Seoul (KR)

(72) Inventors: Youngmun Lee, Seoul (KR); Kiwon Noh, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 3 days.

(21) Appl. No.: 16/849,186

(22) Filed: Apr. 15, 2020

(65) Prior Publication Data

US 2021/0215144 A1 Jul. 15, 2021

(30) Foreign Application Priority Data

Jan. 9, 2020 (KR) ..... 10-2020-0003289

(51) Int. Cl.

| | |
|---|---|
| ***F04B 35/04*** | (2006.01) |
| ***F04B 39/06*** | (2006.01) |
| ***F04B 53/08*** | (2006.01) |
| ***F04B 53/16*** | (2006.01) |
| ***F15B 15/14*** | (2006.01) |
| ***F04B 39/00*** | (2006.01) |
| ***F04B 39/12*** | (2006.01) |

(52) U.S. Cl.

CPC ..... *F04B 35/045* (2013.01); *F04B 39/064* (2013.01); *F04B 53/08* (2013.01); *F04B 53/166* (2013.01); *F15B 15/1485* (2013.01); *F04B 39/0005* (2013.01); *F04B 39/121* (2013.01); *F25B 2400/073* (2013.01)

(58) Field of Classification Search

CPC .. F15B 15/1485; F04B 39/064; F04B 53/166; F04B 53/162; F04B 53/08; F04B 39/121; F25B 2400/073

See application file for complete search history.

(56) References Cited

U.S. PATENT DOCUMENTS

| | | | | |
|---|---|---|---|---|
| 1,791,364 | A * | 2/1931 | James | F04B 39/102 417/534 |
| 2015/0204323 | A1* | 7/2015 | Bouzidi | F04B 39/125 92/169.1 |
| 2015/0226191 | A1* | 8/2015 | Ki | F04B 53/20 417/53 |
| 2016/0017876 | A1* | 1/2016 | Kim | F04B 35/045 417/443 |
| 2021/0095652 | A1* | 4/2021 | Hahn | F04B 39/041 |

FOREIGN PATENT DOCUMENTS

| | | |
|---|---|---|
| EP | 3553314 | 10/2018 |
| EP | 3587811 | 6/2019 |
| KR | 101484324 | 1/2015 |
| KR | 1020170086841 | 7/2017 |
| KR | 1020190036310 | 4/2019 |

OTHER PUBLICATIONS

Extended European Search Report in EP Appln. No. 20196834.4, dated Dec. 23, 2020, 6 pages.

* cited by examiner

*Primary Examiner* — Kenneth J Hansen

*Assistant Examiner* — David N Brandt

(74) *Attorney, Agent, or Firm* — Fish & Richardson P.C.

(57) ABSTRACT

A compressor is disclosed. The compressor compressing and discharging a refrigerant sucked inside a cylinder includes a frame configured to support the cylinder, and a discharge cover assembly disposed in front of the frame. A gas layer is formed between the discharge cover assembly and the frame.

18 Claims, 8 Drawing Sheets

COMPRESSOR

CROSS-REFERENCE TO RELATED APPLICATIONS

This application claims the benefit of Korea Patent Application No. 10-2020-0003289, filed on Jan. 9, 2020, which is incorporated herein by reference for all purposes as if fully set forth herein.

BACKGROUND OF THE INVENTION

Field of the Invention

The present disclosure relates to a compressor. More specifically, the present disclosure relates to a linear compressor for compressing a refrigerant by a linear reciprocating motion of a piston.

Discussion of the Related Art

In general, a compressor refers to a device that is configured to receive power from a power generator such as a motor or a turbine and compress a working fluid such as air or a refrigerant. More specifically, the compressors are widely used in the whole industry or home appliances, especially a steam compression refrigeration cycle (hereinafter, referred to as "refrigeration cycle").

The compressors may be classified into a reciprocating compressor, a rotary compressor, and a scroll compressor according to a method of compressing the refrigerant.

The reciprocating compressor uses a method in which a compression space is formed between a piston and a cylinder, and the piston linearly reciprocates to compress a fluid. The rotary compressor uses a method of compressing a fluid by a roller that eccentrically rotates inside a cylinder. The scroll compressor uses a method of compressing a fluid by engaging and rotating a pair of spiral scrolls.

Recently, among the reciprocating compressors, the use of linear compressors that uses a linear reciprocating motion without using a crank shaft is gradually increasing. The linear compressor has advantages in that it has less mechanical loss resulting from switching a rotary motion to the linear reciprocating motion and thus can improve the efficiency, and has a relatively simple structure.

The linear compressor is configured such that a cylinder is positioned in a casing forming a sealed space to form a compression chamber, and a piston covering the compression chamber reciprocates inside the cylinder. The linear compressor repeats a process in which a fluid in the sealed space is sucked into the compression chamber while the piston is positioned at a bottom dead center (BDC), and the fluid of the compression chamber is compressed and discharged while the piston is positioned at a top dead center (TDC).

A compression unit and a drive unit are installed inside the linear compressor. The compression unit performs a process of compressing and discharging a refrigerant while performing a resonant motion by a resonant spring through a movement generated in the drive unit.

The piston of the linear compressor repeatedly performs a series of processes of sucking the refrigerant into the casing through a suction pipe while reciprocating at high speed inside the cylinder by the resonant spring, and then discharging the refrigerant from a compression space through a forward movement of the piston to move it to a condenser through a discharge pipe.

The linear compressor may be classified into an oil lubricated linear compressor and a gas lubricated linear compressor according to a lubrication method.

The oil lubricated linear compressor is configured to store a predetermined amount of oil in the casing and lubricate between the cylinder and the piston using the oil.

On the other hand, the gas lubricated linear compressor is configured not to store an oil in the casing, induce a part of the refrigerant discharged from the compression space between the cylinder and the piston, and lubricate between the cylinder and the piston by a gas force of the refrigerant.

The oil lubricated linear compressor supplies the oil of a relatively low temperature between the cylinder and the piston and thus can suppress the cylinder and the piston from being overheated by motor heat or compression heat, etc. Hence, the oil lubricated linear compressor suppresses specific volume from increasing as the refrigerant passing through a suction flow path of the piston is sucked into the compression chamber of the cylinder and is heated, and thus can prevent in advance a suction loss from occurring.

However, when the refrigerant and an oil discharged to a refrigeration cycle device are not smoothly returned to the compressor, the oil lubricated linear compressor may experience an oil shortage inside the casing of the compressor. The oil shortage inside the casing may lead to a reduction in the reliability of the compressor.

On the other hand, because the gas lubricated linear compressor can be made smaller than the oil lubricated linear compressor and lubricate between the cylinder and the piston using the refrigerant, the gas lubricated linear compressor has an advantage in that there is no reduction in the reliability of the compressor due to the oil shortage.

When a high temperature and high pressure gas compressed in the compression space passes a discharge space, the high temperature and high pressure gas acts as a heat source and generates heat transfer to a frame of a relatively low temperature, leading to a heat loss and a reduction in compression efficiency.

PRIOR ART DOCUMENT (Patent Document 1) Korean Patent No. 10-1484324 B (published on Jan. 20, 2015)

SUMMARY OF THE INVENTION

An object of the present disclosure is to provide a compressor capable of preventing a heat loss and improving compression efficiency.

In one aspect, there is provided a compressor compressing and discharging a refrigerant sucked inside a cylinder, the compressor comprising a frame configured to support the cylinder; and a discharge cover assembly disposed in front of the frame, wherein a gas layer is formed between the discharge cover assembly and the frame.

The gas layer may extend in an axial direction.

The frame may include a first body portion supporting the cylinder and a first flange portion extending from the first body portion in a radial direction.

The first flange portion may include a first stepped portion formed on an inner surface of the first flange portion. The discharge cover assembly may include a first discharge cover that is formed in a shape corresponding to the first body portion and the first flange portion and is spaced apart from an inner surface of the first body portion and the first stepped portion. The gas layer may include a first parallel portion extending in an axial direction, a first vertical portion extending from a front of the first parallel portion in the radial direction, and a second parallel portion extending forward from an outside of the first vertical portion.

The discharge cover assembly may include a second discharge cover disposed in the first discharge cover, a third discharge cover disposed in front of the second discharge cover, and a fourth discharge cover disposed in front of the first and third discharge covers.

The first discharge cover may include a plurality of partition walls that extends in the radial direction and is spaced apart from each other in the axial direction.

The compressor may further comprise an elastic member between the plurality of partition walls.

The plurality of partition walls may be disposed in a rear area of the first discharge cover.

The first flange portion may include a gas groove formed on an outer surface of the first flange portion. The gas layer may include a second vertical portion that extends from the second parallel portion and is exposed to the outside through the gas groove.

A radial length of the second vertical portion may be greater than a radial length of the first vertical portion.

The first discharge cover may include a second body portion disposed in the first body of the frame, a second stepped portion disposed in front of the second body portion, and a second flange portion extending from a front of the second stepped portion in the radial direction.

A rear surface of the second flange portion may contact a front end of the second parallel portion.

The first flange portion may include a seating groove that is recessed rearward from a front surface of the first flange portion. The second flange portion may be disposed in the seating groove.

The first flange portion may include a gas groove on an outer surface of the first flange portion. The gas layer may include a second vertical portion that extends from the second parallel portion and is exposed to the outside through the gas groove. A rear surface of the second flange portion may contact a front area of the second vertical portion.

An axial length of the first parallel portion may be greater than an axial length of the second parallel portion.

The first discharge cover may include a groove on an outer surface of the first body of the frame. The gas layer may be formed between the groove and the frame.

The gas layer may be disposed in front of the cylinder.

The compressor may further comprise a piston disposed in the cylinder; and a discharge valve disposed in front of the piston and configured to discharge the compressed refrigerant.

The gas layer may not overlap the discharge valve in a radial direction.

The gas layer may not overlap the piston in an axial direction.

The present disclosure can provide a compressor capable of preventing a heat loss and improving compression efficiency.

BRIEF DESCRIPTION OF THE DRAWINGS

The accompanying drawings, that may be included to provide a further understanding of the disclosure and are incorporated in and constitute a part of this specification, illustrate embodiments of the disclosure and together with the description serve to explain various principles of the disclosure.

DETAILED DESCRIPTION

Reference will now be made in detail to embodiments of the disclosure, examples of which are illustrated in the accompanying drawings. Wherever possible, the same reference numbers will be used throughout the drawings to refer to the same or like parts.

In embodiments of the disclosure, when an arbitrary component is described as "being connected to" or "being coupled to" other component, it should be understood that another component(s) may exist between them, although the arbitrary component may be directly connected or coupled to the other component.

It will be noted that a detailed description of known arts will be omitted if it is determined that the detailed description of the known arts can obscure embodiments of the disclosure. The accompanying drawings are used to help easily understand various technical features and it should be understood that embodiments presented herein are not limited by the accompanying drawings. As such, the present disclosure should be understand to extend to any alterations, equivalents and substitutes in addition to those which are particularly set out in the accompanying drawings.

In addition, a term of "disclosure" may be replaced by document, specification, description, etc.

Figure 1:
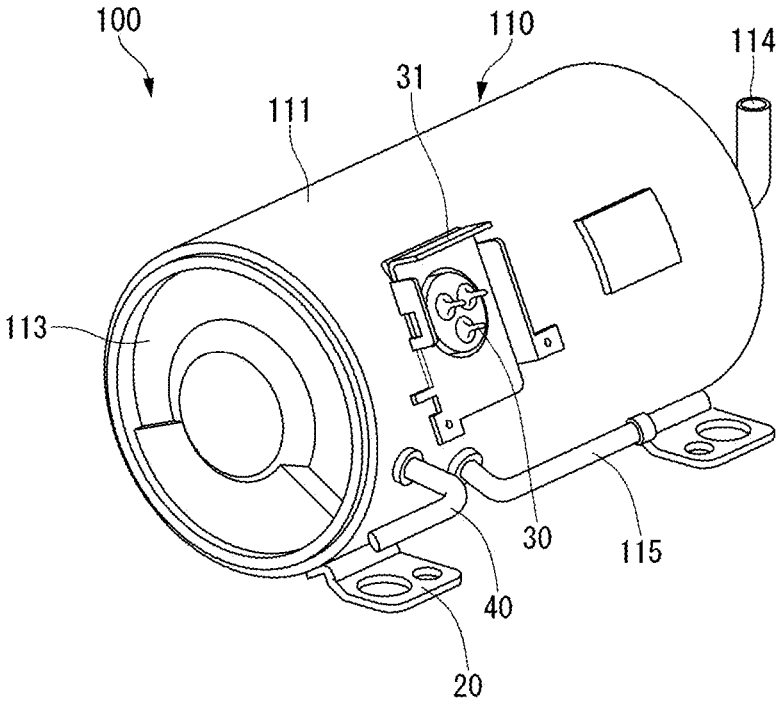
FIG. 1 is a perspective view of a compressor according to an embodiment of the disclosure.

FIG. 1 is a perspective view of a compressor according to an embodiment of the disclosure.

Referring to FIG. 1, a linear compressor 100 according to an embodiment of the disclosure may include a shell 111 and shell covers 112 and 113 coupled to the shell 111. In a broad sense, the shell covers 112 and 113 can be understood as one configuration of the shell 111.

Legs 20 may be coupled to a lower side of the shell 111. The legs 20 may be coupled to a base of a product on which the linear compressor 100 is mounted. For example, the product may include a refrigerator, and the base may include a machine room base of the refrigerator. As another example, the product may include an outdoor unit of an air conditioner, and the base may include a base of the outdoor unit.

The shell 111 may have a substantially cylindrical shape and may be disposed to lie in a horizontal direction or an axial direction. FIG. 1 illustrates that the shell 111 is extended in the horizontal direction and has a slightly low height in a radial direction, by way of example. That is, since the linear compressor 100 can have a low height, there is an advantage in that a height of the machine room can decrease when the linear compressor 100 is installed in, for example, the machine room base of the refrigerator.

A longitudinal central axis of the shell 111 coincides with a central axis of a main body of the compressor 100 to be described later, and the central axis of the main body of the compressor 100 coincides with a central axis of a cylinder 140 and a piston 150 constituting the main body of the compressor 100.

A terminal 30 may be installed on an external surface of the shell 111. The terminal 30 may transmit external electric power to a drive unit 130 of the linear compressor 100. More specifically, the terminal 30 may be connected to a lead line of a coil 132*b*.

A bracket 31 may be installed on the outside of the terminal 30. The bracket 31 may include a plurality of brackets surrounding the terminal 30. The bracket 31 may perform a function of protecting the terminal 30 from an external impact, etc.

Both sides of the shell 111 may be opened. The shell covers 112 and 113 may be coupled to both sides of the opened shell 111. More specifically, the shell covers 112 and 113 may include a first shell cover 112 coupled to one opened side of the shell 111 and a second shell cover 113 coupled to the other opened side of the shell 111. An inner space of the shell 111 may be closed by the shell covers 112 and 113.

FIG. 1 illustrates that the first shell cover 112 is positioned on the right side of the linear compressor 100, and the second shell cover 113 is positioned on the left side of the linear compressor 100, by way of example. In other words, the first and second shell covers 112 and 113 may be disposed to face each other. It can be understood that the first shell cover 112 is positioned on a suction side of a refrigerant, and the second shell cover 113 is positioned on a discharge side of the refrigerant.

The linear compressor 100 may include a plurality of pipes 114, 115, and 40 that is included in the shell 111 or the shell covers 112 and 113 and can suck, discharge, or inject the refrigerant.

The plurality of pipes 114, 115, and 40 may include a suction pipe 114 that allows the refrigerant to be sucked into the linear compressor 100, a discharge pipe 115 that allows the compressed refrigerant to be discharged from the linear compressor 100, and a supplementary pipe 40 for supplementing the refrigerant in the linear compressor 100.

For example, the suction pipe 114 may be coupled to the first shell cover 112. The refrigerant may be sucked into the linear compressor 100 along the axial direction through the suction pipe 114.

The discharge pipe 115 may be coupled to an outer circumferential surface of the shell 111. The refrigerant sucked through the suction pipe 114 may be compressed while flowing in the axial direction. The compressed refrigerant may be discharged through the discharge pipe 115. The discharge pipe 115 may be disposed closer to the second shell cover 113 than to the first shell cover 112.

The supplementary pipe 40 may be coupled to the outer circumferential surface of the shell 111. A worker may inject the refrigerant into the linear compressor 100 through the supplementary pipe 40.

The supplementary pipe 40 may be coupled to the shell 111 at a different height from the discharge pipe 115 in order to prevent interference with the discharge pipe 115. Here, the height may be understood as a distance measured from the leg 20 in a vertical direction. Because the discharge pipe 115 and the supplementary pipe 40 are coupled to the outer circumferential surface of the shell 111 at different heights, the work convenience can be attained.

On an inner circumferential surface of the shell 111 corresponding to a location at which the supplementary pipe 40 is coupled, at least a portion of the second shell cover 113 may be positioned adjacently. In other words, at least a portion of the second shell cover 113 may act as a resistance of the refrigerant injected through the supplementary pipe 40.

Thus, with respect to a flow path of the refrigerant, a size of the flow path of the refrigerant introduced through the supplementary pipe 40 is configured to decrease by the second shell cover 113 while the refrigerant enters into the inner space of the shell 111, and again increase while the refrigerant passes through the second shell cover 113. In this process, a pressure of the refrigerant may be reduced to vaporize the refrigerant, and an oil contained in the refrigerant may be separated. Thus, while the refrigerant, from which the oil is separated, is introduced into the piston 150, a compression performance of the refrigerant can be improved. The oil may be understood as a working oil present in a cooling system.

Figure 2:
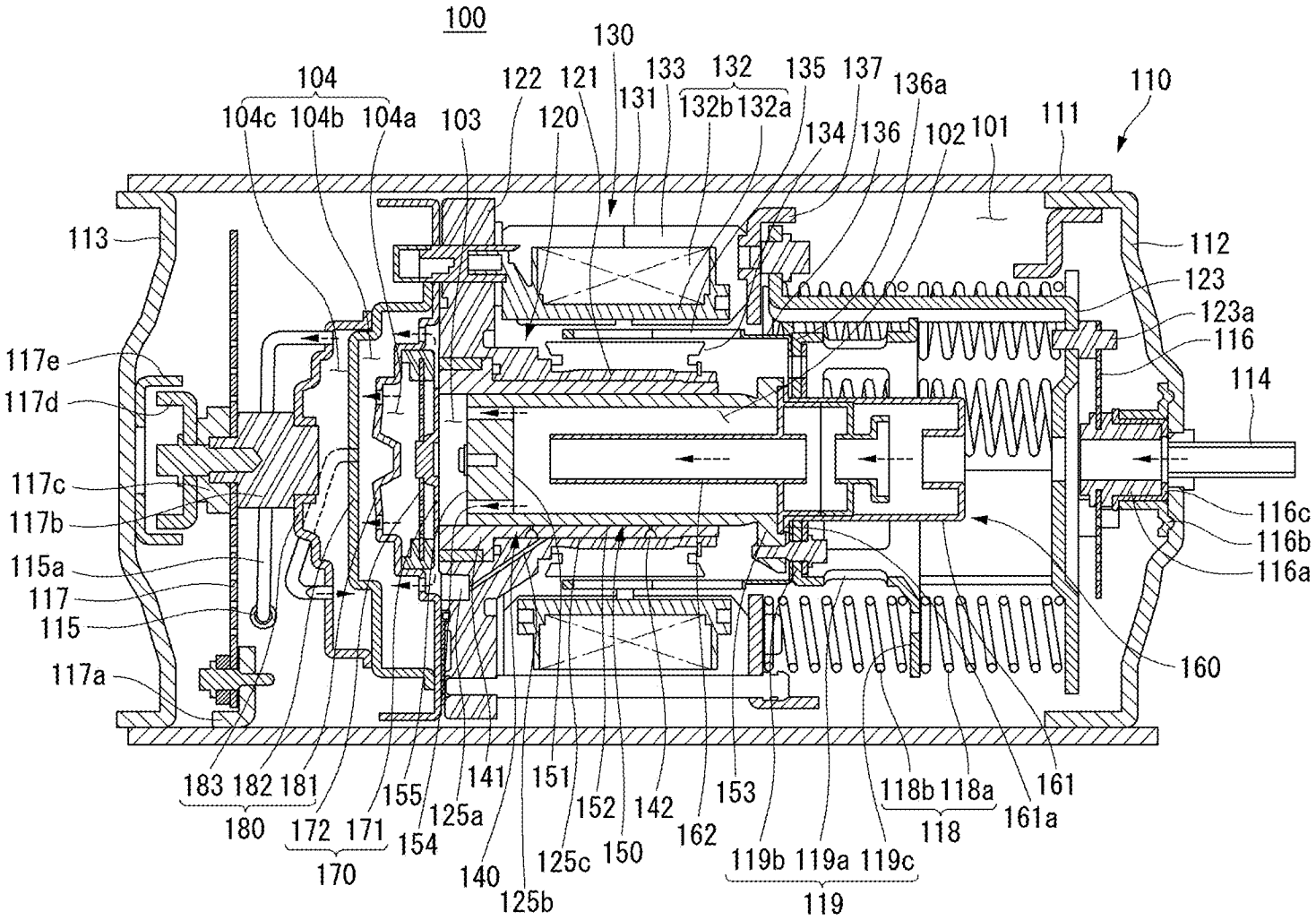
FIG. 2 is a cross-sectional view of a compressor according to an embodiment of the disclosure.

FIG. 2 is a cross-sectional view of a compressor according to an embodiment of the disclosure.

Hereinafter, a compressor according to the present disclosure will be described taking, as an example, a linear compressor that sucks and compresses a fluid while a piston linearly reciprocates, and discharges the compressed fluid.

The linear compressor may be a component of a refrigeration cycle, and the fluid compressed in the linear compressor may be a refrigerant circulating the refrigeration cycle. The refrigeration cycle may include a condenser, an expander, an evaporator, etc., in addition to the compressor. The linear compressor may be used as a component of the cooling system of the refrigerator, but is not limited thereto. The linear compressor can be widely used in the whole industry.

Referring to FIG. 2, the compressor 100 may include a casing 110 and a main body accommodated in the casing 110. The main body of the compressor 100 may include a frame 120, the cylinder 140 fixed to the frame 120, the piston 150 that linearly reciprocates inside the cylinder 140, the drive unit 130 that is fixed to the frame 120 and gives a driving force to the piston 150, and the like. Here, the cylinder 140 and the piston 150 may be referred to as compression units 140 and 150.

The compressor 100 may include a bearing means for reducing a friction between the cylinder 140 and the piston 150. The bearing means may be an oil bearing or a gas bearing. Alternatively, a mechanical bearing may be used as the bearing means.

The main body of the compressor 100 may be elastically supported by support springs 116 and 117 installed at both ends inside the casing 110. The support springs 116 and 117 may include a first support spring 116 for supporting the rear of the main body and a second support spring 117 for supporting the front of the main body. The support springs 116 and 117 may include a leaf spring. The support springs 116 and 117 can absorb vibrations and impacts generated by a reciprocating motion of the piston 150 while supporting the internal parts of the main body of the compressor 100.

The casing 110 may form a sealed space. The sealed space may include an accommodation space 101 in which the sucked refrigerant is accommodated, a suction space 102 which is filled with the refrigerant before the compression, a compression space 103 in which the refrigerant is compressed, and a discharge space 104 which is filled with the compressed refrigerant.

The refrigerant sucked from the suction pipe 114 connected to the rear side of the casing 110 may be filled in the accommodation space 101, and the refrigerant in the suction space 102 communicating with the accommodation space 101 may be compressed in the compression space 103, discharged to the discharge space 104, and discharged to the outside through the discharge pipe 115 connected to the front side of the casing 110.

The casing 110 may include the shell 111 formed in a substantially cylindrical shape that is open at both ends and is long in a transverse direction, the first shell cover 112 coupled to the rear side of the shell 111, and the second shell cover 113 coupled to the front side of the shell 111. Here, it can be understood that the front side is the left side of the figure and is a direction in which the compressed refrigerant is discharged, and the rear side is the right side of the figure and is a direction in which the refrigerant is introduced. Further, the first shell cover 112 and the second shell cover 113 may be formed as one body with the shell 11.

The casing 110 may be formed of a thermally conductive material. Hence, heat generated in the inner space of the casing 110 can be quickly dissipated to the outside.

The first shell cover 112 may be coupled to the shell 111 in order to seal the rear of the shell 111, and the suction pipe 114 may be inserted and coupled to the center of the first shell cover 112.

The rear of the main body of the compressor 100 may be elastically supported by the first support spring 116 in the radial direction of the first shell cover 112.

The first support spring 116 may include a circular leaf spring. An edge of the first support spring 116 may be elastically supported by a support bracket 123*a* in a forward direction with respect to a back cover 123. An opened center portion of the first support spring 116 may be supported by a suction guide 116*a* in a rearward direction with respect to the first shell cover 112.

The suction guide 116*a* may have a through passage formed therein. The suction guide 116*a* may be formed in a cylindrical shape. A front outer circumferential surface of the suction guide 116*a* may be coupled to a central opening of the first support spring 116, and a rear end of the suction guide 116*a* may be supported by the first shell cover 112. In this instance, a separate suction side support member 116*b* may be interposed between the suction guide 116*a* and an inner surface of the first shell cover 112.

A rear side of the suction guide 116*a* may communicate with the suction pipe 114, and the refrigerant sucked through the suction pipe 114 may pass through the suction guide 116*a* and may be smoothly introduced into a muffler unit 160 to be described later.

A damping member 116*c* may be disposed between the suction guide 116*a* and the suction side support member 116*b*. The damping member 116*c* may be formed of a rubber material or the like. Hence, a vibration that may occur in the process of sucking the refrigerant through the suction pipe 114 can be prevented from being transmitted to the first shell cover 112.

The second shell cover 113 may be coupled to the shell 111 to seal the front side of the shell 111, and the discharge pipe 115 may be inserted and coupled through a loop pipe 115*a*. The refrigerant discharged from the compression space 103 may pass through a discharge cover assembly 180 and then may be discharged into the refrigeration cycle through the loop pipe 115*a* and the discharge pipe 115.

A front side of the main body of the compressor 100 may be elastically supported by the second support spring 117 in the radial direction of the shell 111 or the second shell cover 113.

The second support spring 117 may include a circular leaf spring. An opened center portion of the second support spring 117 may be supported by a first support guide 117*b* in a rearward direction with respect to the discharge cover assembly 180. An edge of the second support spring 117 may be supported by a support bracket 117*a* in a forward direction with respect to the inner surface of the shell 111 or the inner circumferential surface of the shell 111 adjacent to the second shell cover 113.

Unlike FIG. 2, the edge of the second support spring 117 may be supported in the forward direction with respect to the inner surface of the shell 111 or the inner circumferential surface of the shell 111 adjacent to the second shell cover 113 through a separate bracket (not shown) coupled to the second shell cover 113.

The first support guide 117*b* may be formed in a cylindrical shape. A cross section of the first support guide 117 may have a plurality of diameters. A front side of the first support guide 117 may be inserted into a central opening of the second support spring 117, and a rear side of the first support guide 117 may be inserted into a central opening of the discharge cover assembly 180. A support cover 117*c* may be coupled to the front side of the first support guide 117*b* with the second support spring 117 interposed therebetween. A cup-shaped second support guide 117*d* that is recessed forward may be coupled to the front side of the support cover 117*c*. A cup-shaped third support guide 117*e* that corresponds to the second support guide 117*d* and is recessed rearward may be coupled to the inside of the second shell cover 113. The second support guide 117*d* may be inserted into the third support guide 117*e* and may be supported in the axial direction and/or the radial direction. In this instance, a gap may be formed between the second support guide 117*d* and the third support guide 117*e*.

The frame 120 may include a body portion 121 supporting the outer circumferential surface of the cylinder 140, and a first flange portion 122 that is connected to one side of the body portion 121 and supports the drive unit 130. The frame 120 may be elastically supported with respect to the casing 110 by the first and second support springs 116 and 117 together with the drive unit 130 and the cylinder 140.

The body portion 121 may wrap the outer circumferential surface of the cylinder 140. The body portion 121 may be formed in a cylindrical shape. The first flange portion 122 may extend from a front end of the body portion 121 in the radial direction.

The cylinder 140 may be coupled to an inner circumferential surface of the body portion 121. An inner stator 134 may be coupled to an outer circumferential surface of the body portion 121. For example, the cylinder 140 may be pressed and fitted to the inner circumferential surface of the body portion 121, and the inner stator 134 may be fixed using a separate fixing ring (not shown).

An outer stator 131 may be coupled to a rear surface of the first flange portion 122, and the discharge cover assembly 180 may be coupled to a front surface of the first flange portion 122. For example, the outer stator 131 and the discharge cover assembly 180 may be fixed through a mechanical coupling means.

On one side of the front surface of the first flange portion 122, a bearing inlet groove 125*a* forming a part of the gas bearing may be formed, a bearing communication hole 125*b* penetrating from the bearing inlet groove 125*a* to the inner circumferential surface of the body portion 121 may be formed, and a gas groove 125*c* communicating with the bearing communication hole 125*b* may be formed on the inner circumferential surface of the body portion 121.

The bearing inlet groove 125*a* may be recessed to a predetermined depth in the axial direction. The bearing communication hole 125*b* is a hole having a smaller cross-sectional area than the bearing inlet groove 125*a* and may be inclined toward the inner circumferential surface of the body portion 121. The gas groove 125*c* may be formed in an annular shape having a predetermined depth and an axial length on the inner circumferential surface of the body portion 121. Alternatively, the gas groove 125*c* may be formed on the outer circumferential surface of the cylinder 140 in contact with the inner circumferential surface of the body portion 121, or formed on both the inner circumferential surface of the body portion 121 and the outer circumferential surface of the cylinder 140.

In addition, a gas inlet 142 corresponding to the gas groove 125*c* may be formed on the outer circumferential surface of the cylinder 140. The gas inlet 142 forms a kind of nozzle in the gas bearing.

The frame 120 and the cylinder 140 may be formed of aluminum or an aluminum alloy material.

The cylinder 140 may be formed in a cylindrical shape that is open at both ends. The piston 150 may be inserted through a rear end of the cylinder 140. A front end of the cylinder 140 may be closed via a discharge valve assembly 170. The compression space 103 may be formed between the cylinder 140, a front end of the piston 150, and the discharge valve assembly 170. Here, the front end of the piston 150 may be referred to as a head portion 151. The compression space 103 increases in volume when the piston 150 moves backward, and decreases in volume as the piston 150 moves forward. That is, the refrigerant introduced into the compression space 103 may be compressed while the piston 150 moves forward, and may be discharged through the discharge valve assembly 170.

The cylinder 140 may include a second flange portion 141 disposed at the front end. The second flange portion 141 may bend to the outside of the cylinder 140. The second flange portion 141 may extend in an outer circumferential direction of the cylinder 140. The second flange portion 141 of the cylinder 140 may be coupled to the frame 120. For example, the front end of the frame 120 may include a flange groove corresponding to the second flange portion 141 of the cylinder 140, and the second flange portion 141 of the cylinder 140 may be inserted into the flange groove and coupled through a coupling member.

A gas bearing means may be provided to supply a discharge gas to a gap between the outer circumferential surface of the piston 150 and the outer circumferential surface of the cylinder 140 and lubricate between the cylinder 140 and the piston 150 with gas. The discharge gas between the cylinder 140 and the piston 150 may provide a floating force to the piston 150 to reduce a friction generated between the piston 150 and the cylinder 140.

For example, the cylinder 140 may include the gas inlet 142. The gas inlet 142 may communicate with the gas groove 125*c* formed on the inner circumferential surface of the body portion 121. The gas inlet 142 may pass through the cylinder 140 in the radial direction. The gas inlet 142 may guide the compressed refrigerant introduced in the gas groove 125*c* between the inner circumferential surface of the cylinder 140 and the outer circumferential surface of the piston 150. Alternatively, the gas groove 125*c* may be formed on the outer circumferential surface of the cylinder 140 in consideration of the convenience of processing.

An entrance of the gas inlet 142 may be formed relatively widely, and an exit of the gas inlet 142 may be formed as a fine through hole to serve as a nozzle. The entrance of the gas inlet 142 may further include a filter (not shown) blocking the inflow of foreign matter. The filter may be a metal mesh filter, or may be formed by winding a member such as fine thread.

The plurality of gas inlets 142 may be independently formed. Alternatively, the entrance of the gas inlet 142 may be formed as an annular groove, and a plurality of exits may be formed along the annular groove at regular intervals. The gas inlet 142 may be formed only at the front side based on the axial middle of the cylinder 140. On the contrary, the gas inlet 142 may be formed at the rear side based on the axial middle of the cylinder 140 in consideration of the sagging of the piston 150.

The piston 150 is inserted into the opened rear end of the cylinder 140 and is provided to seal the rear of the compression space 103.

The piston 150 may include a head 151 and a guide 152. The head 151 may be formed in a disc shape. The head 151 may be partially open. The head 151 may partition the compression space 103. The guide 152 may extend rearward from an outer circumferential surface of the head 151. The guide 152 may be formed in a cylindrical shape. The inside of the guide 152 may be empty, and the front of the guide 152 may be partially sealed by the head 151. The rear of the guide 152 may be opened and connected to the muffler unit 160. The head 151 may be provided as a separate member coupled to the guide 152. Alternatively, the head 151 and the guide 152 may be formed as one body.

The piston 150 may include a suction port 154. The suction port 154 may pass through the head 151. The suction port 154 may communicate with the suction space 102 and the compression space 103 inside the piston 150. For example, the refrigerant flowing from the accommodation space 101 to the suction space 102 inside the piston 150 may pass through the suction port 154 and may be sucked into the compression space 103 between the piston 150 and the cylinder 140.

The suction port 154 may extend in the axial direction of the piston 150. The suction port 154 may be inclined in the axial direction of the piston 150. For example, the suction port 154 may extend to be inclined in a direction away from the central axis as it goes to the rear of the piston 150.

A cross section of the suction port 154 may be formed in a circular shape. The suction port 154 may have a constant inner diameter. In contrast, the suction port 154 may be formed as a long hole in which an opening extends in the radial direction of the head 151, or may be formed such that the inner diameter becomes larger as it goes to the rear.

The plurality of suction ports 154 may be formed in one or more of the radial direction and the circumferential direction of the head 151.

The head 151 of the piston 150 adjacent to the compression space 103 may be equipped with a suction valve 155 for selectively opening and closing the suction port 154. The suction valve 155 may operate by elastic deformation to open or close the suction port 154. That is, the suction valve 155 may be elastically deformed to open the suction port 154 by the pressure of the refrigerant flowing into the compression space 103 through the suction port 154.

The piston 150 may be connected to a mover 135. The mover 135 may reciprocate forward and backward according to the movement of the piston 150. The inner stator 134 and the cylinder 140 may be disposed between the mover 135 and the piston 150. The mover 135 and the piston 150 may be connected to each other by a magnet frame 136 that is formed by detouring the cylinder 140 and the inner stator 134 to the rear.

The muffler unit 160 may be coupled to the rear of the piston 150 to reduce a noise generated in the process of sucking the refrigerant into the piston 150. The refrigerant sucked through the suction pipe 114 may flow into the suction space 102 inside the piston 150 via the muffler unit 160.

The muffler unit 160 may include a suction muffler 161 communicating with the accommodation space 101 of the casing 110, and an inner guide 162 that is connected to the front of the suction muffler 161 and guides the refrigerant to the suction port 154.

The suction muffler 161 may be positioned in the rear of the piston 150. A rear opening of the suction muffler 161 may be disposed adjacent to the suction pipe 114, and a front end of the suction muffler 161 may be coupled to the rear of the piston 150. The suction muffler 161 may have a flow path formed in the axial direction to guide the refrigerant in the accommodation space 101 to the suction space 102 inside the piston 150.

The inside of the suction muffler 161 may include a plurality of noise spaces partitioned by a baffle. The suction muffler 161 may be formed by combining two or more members. For example, a second suction muffler may be press-coupled to the inside of a first suction muffler to form a plurality of noise spaces. In addition, the suction muffler 161 may be formed of a plastic material in consideration of weight or insulation property.

One side of the inner guide 162 may communicate with the noise space of the suction muffler 161, and other side may be deeply inserted into the piston 150. The inner guide 162 may be formed in a pipe shape. Both ends of the inner guide 162 may have the same inner diameter. The inner guide 162 may be formed in a cylindrical shape. Alternatively, an inner diameter of a front end that is a discharge side of the inner guide 162 may be greater than an inner diameter of a rear end opposite the front end.

The suction muffler 161 and the inner guide 162 may be provided in various shapes and may adjust the pressure of the refrigerant passing through the muffler unit 160. The suction muffler 161 and the inner guide 162 may be formed as one body.

The discharge valve assembly 170 may include a discharge valve 171 and a valve spring 172 that is provided on a front side of the discharge valve 171 to elastically support the discharge valve 171. The discharge valve assembly 170 may selectively discharge the compressed refrigerant in the compression space 103. Here, the compression space 103 means a space between the suction valve 155 and the discharge valve 171.

The discharge valve 171 may be disposed to be supportable on the front surface of the cylinder 140. The discharge valve 171 may selectively open and close the front opening of the cylinder 140. The discharge valve 171 may operate by elastic deformation to open or close the compression space 103. The discharge valve 171 may be elastically deformed to open the compression space 103 by the pressure of the refrigerant flowing into the discharge space 104 through the compression space 103. For example, the compression space 103 may maintain a sealed state while the discharge valve 171 is supported on the front surface of the cylinder 140, and the compressed refrigerant of the compression space 103 may be discharged to an opened space in a state where the discharge valve 171 is spaced apart from the front surface of the cylinder 140.

The valve spring 172 may be provided between the discharge valve 171 and the discharge cover assembly 180 to provide an elastic force in the axial direction. The valve spring 172 may be provided as a compression coil spring, or may be provided as a leaf spring in consideration of an occupied space or reliability.

When the pressure of the compression space 103 is equal to or greater than a discharge pressure, the valve spring 172 may open the discharge valve 171 while deforming forward, and the refrigerant may be discharged from the compression space 103 and discharged to a first discharge space 104*a* of the discharge cover assembly 180. When the discharge of the refrigerant is completed, the valve spring 172 provides a restoring force to the discharge valve 171 and thus can allow the discharge valve 171 to be closed.

A process of introducing the refrigerant into the compression space 103 through the suction valve 155 and discharging the refrigerant of the compression space 103 to the discharge space 104 through the discharge valve 171 is described as follows.

In the process in which the piston 150 linearly reciprocates inside the cylinder 140, if the pressure of the compression space 103 is equal to or less than a predetermined suction pressure, the suction valve 155 is opened and thus the refrigerant is sucked into a compression space 103. On the other hand, if the pressure of the compression space 103 exceeds the predetermined suction pressure, the refrigerant of the compression space 103 is compressed in a state in which the suction valve 155 is closed.

If the pressure of the compression space 103 is equal to or greater than the predetermined suction pressure, the valve spring 172 deforms forward and opens the discharge valve 171 connected to the valve spring 172, and the refrigerant is discharged from the compression space 103 to the discharge space 104 of the discharge cover assembly 180. When the discharge of the refrigerant is completed, the valve spring 172 provides a restoring force to the discharge valve 171 and allows the discharge valve 171 to be closed, thereby sealing the front of the compression space 103.

The discharge cover assembly 180 is installed in front of the compression space 103, forms a discharge space 104 for accommodating the refrigerant discharged from the compression space 103, and is coupled to the front of the frame 120 to thereby reduce a noise generated in the process of discharging the refrigerant from the compression space 103. The discharge cover assembly 180 may be coupled to the front of the first flange portion 122 of the frame 120 while accommodating the discharge valve assembly 170. For example, the discharge cover assembly 180 may be coupled to the first flange portion 122 through a mechanical coupling member.

An O-ring 166 may be provided between the discharge cover assembly 180 and the frame 120 to prevent the refrigerant in a gasket 165 for thermal insulation and the discharge space 104 from leaking.

The discharge cover assembly 180 may be formed of a thermally conductive material. Therefore, when a high temperature refrigerant is introduced into the discharge cover assembly 180, heat of the refrigerant may be transferred to the casing 110 through the discharge cover assembly 180 and dissipated to the outside of the compressor.

The discharge cover assembly 180 may include one discharge cover, or may be arranged so that a plurality of discharge covers sequentially communicates with each other. When the discharge cover assembly 180 is provided with the plurality of discharge covers, the discharge space 104 may include a plurality of spaces partitioned by the respective discharge covers. The plurality of spaces may be disposed in a front-rear direction and may communicate with each other.

For example, when there are three discharge covers, the discharge space 104 may include a first discharge space 104*a* between the frame 120 and a first discharge cover 181 coupled to the front side of the frame 120, a second discharge space 104*b* between the first discharge cover 181 and a second discharge cover 182 that communicates with the first discharge space 104*a* and is coupled to a front side of the first discharge cover 181, and a third discharge space 104*c* between the second discharge cover 182 and a third discharge cover 183 that communicates with the second discharge space 104*b* and is coupled to a front side of the second discharge cover 182.

The first discharge space 104*a* may selectively communicate with the compression space 103 by the discharge valve 171, the second discharge space 104*b* may communicate with the first discharge space 104*a*, and the third discharge space 104*c* may communicate with the second discharge space 104*b*. Hence, as the refrigerant discharged from the compression space 103 sequentially passes through the first discharge space 104*a*, the second discharge space 104*b*, and the third discharge space 104*c*, a discharge noise can be reduced, and the refrigerant can be discharged to the outside of the casing 110 through the loop pipe 115*a* and the discharge pipe 115 communicating with the third discharge cover 183.

The drive unit 130 may include the outer stator 131 that is disposed between the shell 111 and the frame 120 and surrounds the body portion 121 of the frame 120, the inner stator 134 that is disposed between the outer stator 131 and the cylinder 140 and surrounds the cylinder 140, and the mover 135 disposed between the outer stator 131 and the inner stator 134.

The outer stator 131 may be coupled to the rear of the first flange portion 122 of the frame 120, and the inner stator 134 may be coupled to the outer circumferential surface of the body portion 121 of the frame 120. The inner stator 134 may be spaced apart from the inside of the outer stator 131, and the mover 135 may be disposed in a space between the outer stator 131 and the inner stator 134.

The outer stator 131 may be equipped with a winding coil, and the mover 135 may include a permanent magnet. The permanent magnet may consist of a single magnet with one pole or configured by combining a plurality of magnets with three poles.

The outer stator 131 may include a coil winding 132 surrounding the axial direction in the circumferential direction and a stator core 133 stacked while surrounding the coil winding 132. The coil winding 132 may include a hollow cylindrical bobbin 132*a* and a coil 132*b* wound in a circumferential direction of the bobbin 132*a*. A cross section of the coil 132*b* may be formed in a circular or polygonal shape, for example, may have a hexagonal shape. In the stator core 133, a plurality of lamination sheets may be laminated radially, or a plurality of lamination blocks may be laminated along the circumferential direction.

The front side of the outer stator 131 may be supported by the first flange portion 122 of the frame 120, and the rear side thereof may be supported by a stator cover 137. For example, the stator cover 137 may be provided in a hollow disc shape, a front surface of the stator cover 137 may be supported by the outer stator 131, and a rear surface thereof may be supported by a resonant spring 118.

The inner stator 134 may be configured by stacking a plurality of laminations on the outer circumferential surface of the body portion 121 of the frame 120 in the circumferential direction.

One side of the mover 135 may be coupled to and supported by the magnet frame 136. The magnet frame 136 has a substantially cylindrical shape and may be disposed to be inserted into a space between the outer stator 131 and the inner stator 134. The magnet frame 136 may be coupled to the rear side of the piston 150 to move together with the piston 150.

As an example, a rear end of the magnet frame 136 is bent and extended inward in the radial direction to form a first coupling portion 136*a*, and the first coupling portion 136*a* may be coupled to a third flange portion 153 formed in the rear of the piston 150. The first coupling portion 136*a* of the magnet frame 136 and the third flange portion 153 of the piston 150 may be coupled through a mechanical coupling member.

A fourth flange portion 161*a* in front of the suction muffler 161 may be interposed between the third flange portion 153 of the piston 150 and the first coupling portion 136*a* of the magnet frame 136. Thus, the piston 150, the muffler unit 160, and the mover 135 can linearly reciprocate together in a combined state.

When a current is applied to the drive unit 130, a magnetic flux may be formed in the winding coil, and an electromagnetic force may occur by an interaction between the magnetic flux formed in the winding coil of the outer stator 131 and a magnetic flux formed by the permanent magnet of the mover 135 to move the mover 135. At the same time as the axial reciprocating movement of the mover 135, the piston 150 connected to the magnet frame 136 may also reciprocate integrally with the mover 135 in the axial direction.

The drive unit 130 and the compression units 140 and 150 may be supported by the support springs 116 and 117 and the resonant spring 118 in the axial direction.

The resonant spring 118 amplifies the vibration implemented by the reciprocating motion of the mover 135 and the piston 150 and thus can achieve an effective compression of the refrigerant. More specifically, the resonant spring 118 may be adjusted to a frequency corresponding to a natural frequency of the piston 150 to allow the piston 150 to perform a resonant motion. Further, the resonant spring 118 generates a stable movement of the piston 150 and thus can reduce the generation of vibration and noise.

The resonant spring 118 may be a coil spring extending in the axial direction. Both ends of the resonant spring 118 may be connected to a vibrating body and a fixed body, respectively. For example, one end of the resonant spring 118 may be connected to the magnet frame 136, and the other end may be connected to the back cover 123. Therefore, the resonant spring 118 may be elastically deformed between the vibrating body vibrating at one end and the fixed body fixed to the other end.

A natural frequency of the resonant spring 118 may be designed to match a resonant frequency of the mover 135 and the piston 150 during the operation of the compressor 100, thereby amplifying the reciprocating motion of the piston 150. However, because the back cover 123 provided as the fixing body is elastically supported by the first support spring 116 in the casing 110, the back cover 123 may not be strictly fixed.

The resonant spring 118 may include a first resonant spring 118*a* supported on the rear side and a second resonant spring 118*b* supported on the front side based on a spring supporter 119.

The spring supporter 119 may include a body portion 119*a* surrounding the suction muffler 161, a second coupling portion 119*b* that is bent from the front of the body portion 119*a* in the inward radial direction, and a support portion 119*c* that is bent from the rear of the body portion 119*a* in the outward radial direction.

A front surface of the second coupling portion 119*b* of the spring supporter 119 may be supported by the first coupling portion 136*a* of the magnet frame 136. An inner diameter of the second coupling portion 119*b* of the spring supporter 119 may cover an outer diameter of the suction muffler 161. For example, the second coupling portion 119*b* of the spring supporter 119, the first coupling portion 136*a* of the magnet frame 136, and the third flange portion 153 of the piston 150 may be sequentially disposed and then integrally coupled via a mechanical member. In this instance, the description that the fourth flange portion 161*a* of the suction muffler 161 can be interposed between the third flange portion 153 of the piston 150 and the first coupling portion 136*a* of the magnet frame 136, and they can be fixed together is the same as that described above.

The first resonant spring 118*a* may be disposed between a front surface of the back cover 123 and a rear surface of the spring supporter 119. The second resonant spring 118*b* may be disposed between a rear surface of the stator cover 137 and a front surface of the spring supporter 119.

A plurality of first and second resonant springs 118*a* and 118*b* may be disposed in the circumferential direction of the central axis. The first resonant springs 118*a* and the second resonant springs 118*b* may be disposed parallel to each other in the axial direction, or may be alternately disposed. The first and second resonant springs 118*a* and 118*b* may be disposed at regular intervals in the radial direction of the central axis. For example, three first resonant springs 118*a* and three second resonant springs 118*b* may be provided and may be disposed at intervals of 120 degrees in the radial direction of the central axis.

The compressor 100 may include a plurality of sealing members that can increase a coupling force between the frame 120 and the components around the frame 120.

For example, the plurality of sealing members may include a first sealing member that is interposed at a portion where the frame 120 and the discharge cover assembly 180 are coupled and is inserted into an installation groove provided at the front end of the frame 120, and a second sealing member that is provided at a portion at which the frame 120 and the cylinder 140 are coupled and is inserted into an installation groove provided at an outer surface of the cylinder 140. The second sealing member can prevent the refrigerant of the gas groove 125*c* between the inner circumferential surface of the frame 120 and the outer circumferential surface of the cylinder 140 from leaking to the outside, and can increase a coupling force between the frame 120 and the cylinder 140. The plurality of sealing members may further include a third sealing member that is provided at a portion at which the frame 120 and the inner stator 134 are coupled and is inserted into an installation groove provided at the outer surface of the frame 120. Here, the first to third sealing members may have a ring shape.

An operation of the linear compressor 100 described above is as follows.

First, when a current is applied to the drive unit 130, a magnetic flux may be formed in the outer stator 131 by the current flowing in the coil 132*b*. The magnetic flux formed in the outer stator 131 may generate an electromagnetic force, and the mover 135 including the permanent magnet may linearly reciprocate by the generated electromagnetic force. The electromagnetic force is generated in a direction (forward direction) in which the piston 150 is directed toward a top dead center (TDC) during a compression stroke, and is alternately generated in a direction (rearward direction) in which the piston 150 is directed toward a bottom dead center (BDC) during a suction stroke. That is, the drive unit 130 may generate a thrust which is a force for pushing the mover 135 and the piston 150 in a moving direction.

The piston 150 linearly reciprocating inside the cylinder 140 may repeatedly increase or reduce volume of the compression space 103.

When the piston 150 moves in a direction (rearward direction) of increasing the volume of the compression space 103, a pressure of the compression space 103 may decrease. Hence, the suction valve 155 mounted in front of the piston 150 is opened, and the refrigerant remaining in the suction space 102 may be sucked into the compression space 103 along the suction port 154. The suction stroke may be performed until the piston 150 is positioned in the bottom dead center by maximally increasing the volume of the compression space 103.

The piston 150 reaching the bottom dead center may perform the compression stroke which switching its motion direction and moving in a direction (forward direction) of reducing the volume of the compression space 103. As the pressure of the compression space 103 increases during the compression stroke, the sucked refrigerant may be compressed. When the pressure of the compression space 103 reaches a setting pressure, the discharge valve 171 is pushed out by the pressure of the compression space 103 and is opened from the cylinder 140, and the refrigerant can be discharged to the discharge space 104 through a separation space. The compression stroke can continue while the piston 150 moves to the top dead center at which the volume of the compression space 103 is minimized.

As the suction stroke and the compression stroke of the piston 150 are repeated, the refrigerant introduced into the accommodation space 101 inside the compressor 100 through the suction pipe 114 may be introduced into the suction space 102 inside the piston 150 by sequentially passing the suction guide 116*a*, the suction muffler 161, and the inner guide 162, and the refrigerant of the suction space 102 may be introduced into the compression space 103 inside the cylinder 140 during the suction stroke of the piston 150. After the refrigerant of the compression space 103 is compressed and discharged to the discharge space 104 during the compression stroke of the piston 150, the refrigerant may be discharged to the outside of the compressor 100 via the loop pipe 115*a* and the discharge pipe 115.

Figure 3:
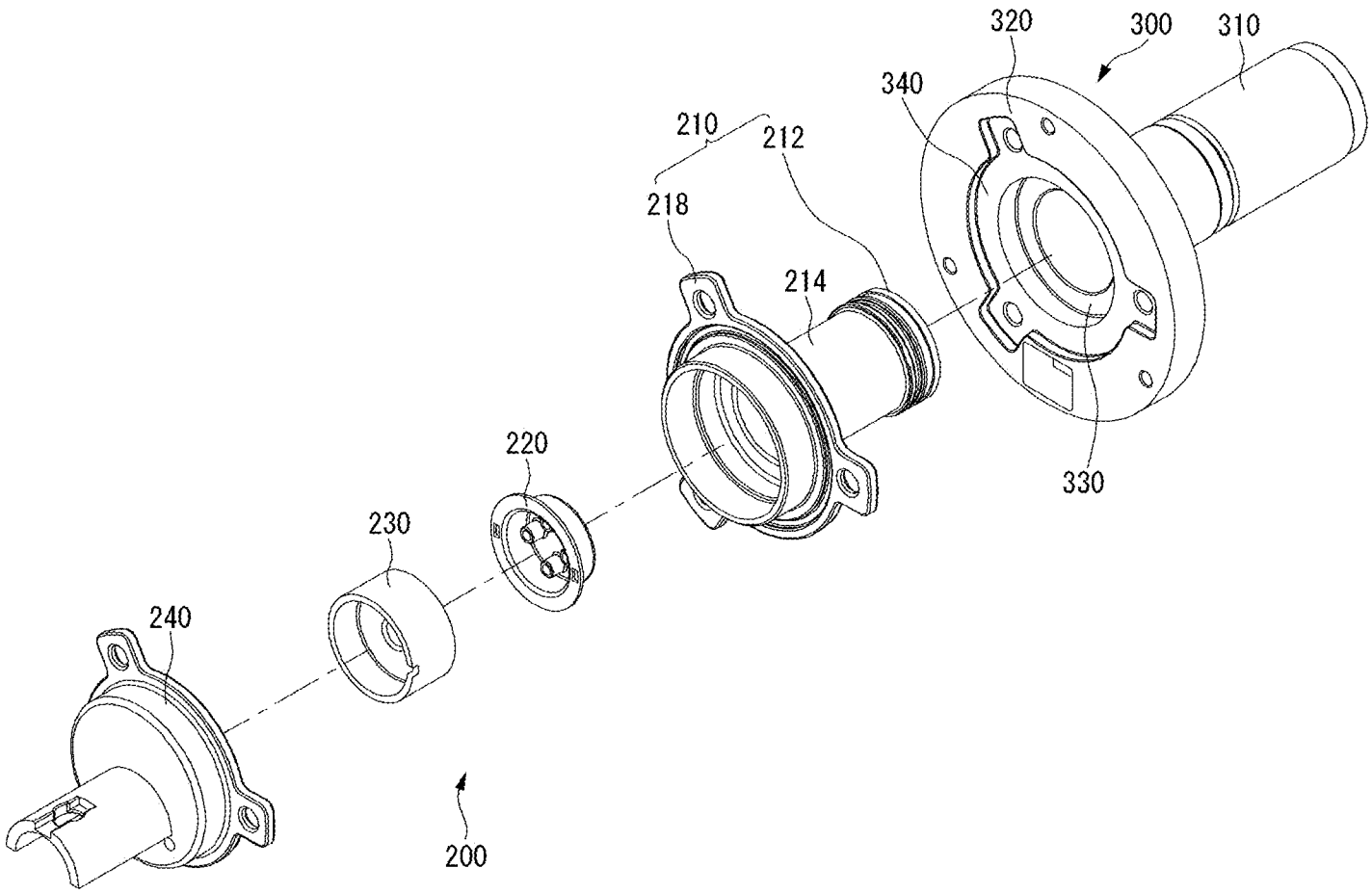
FIG. 3 is an exploded perspective view of a frame and a discharge cover assembly according to an embodiment of the disclosure.
Figure 4:
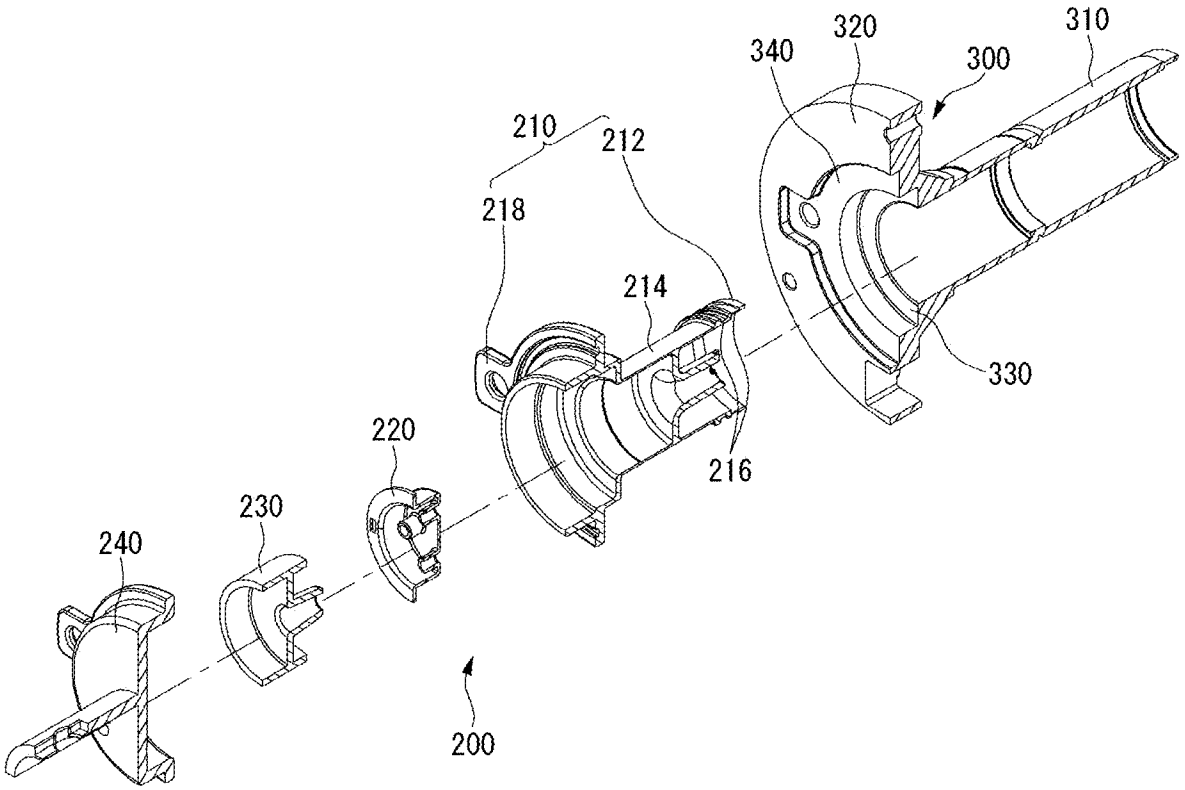
FIG. 4 is a cross-sectional view of FIG. 3.
Figure 5:
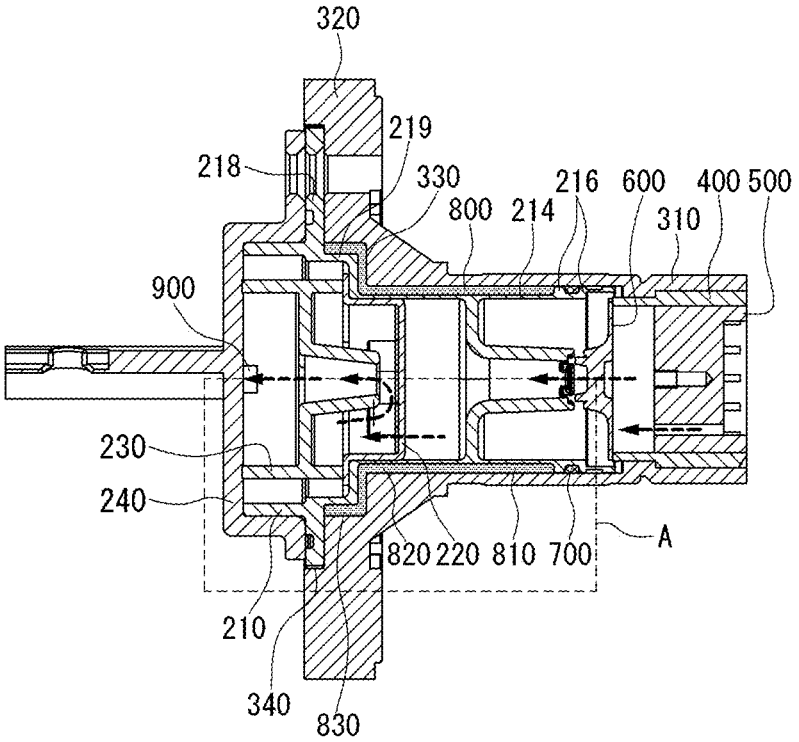
FIG. 5 is a cross-sectional view of a frame and a discharge cover assembly according to an embodiment of the disclosure.
Figure 6:
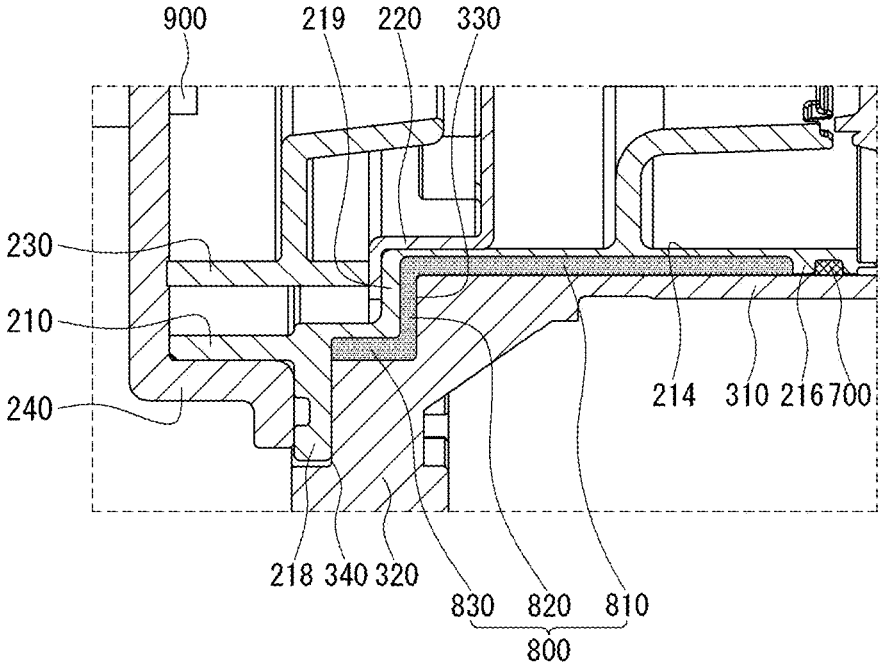
FIG. 6 is an enlarged view a portion A of FIG. 5.
Figure 7:
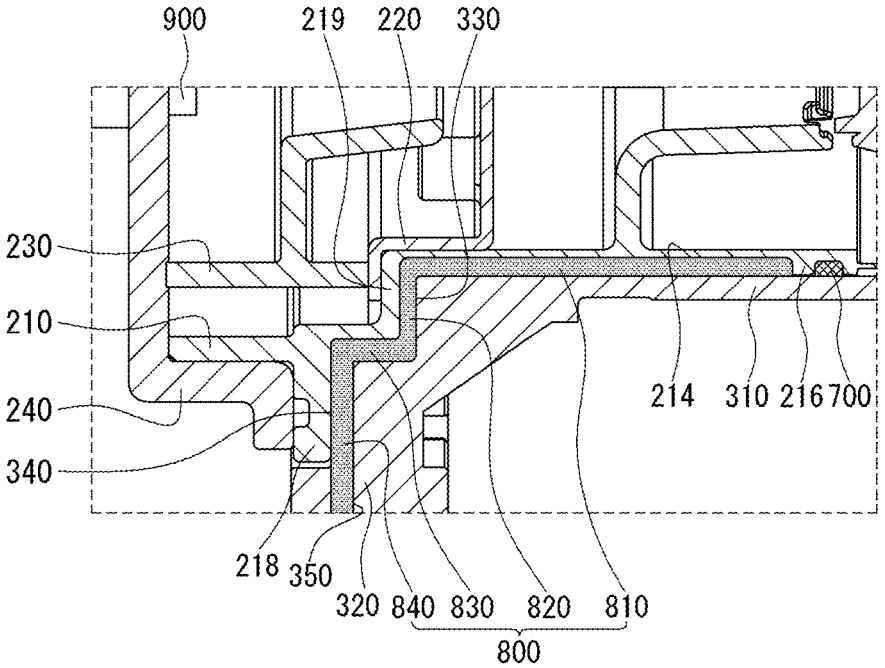
FIG. 7 is a modified example of FIG. 6.

FIG. 3 is an exploded perspective view of a frame and a discharge cover assembly according to an embodiment of the disclosure. FIG. 4 is a cross-sectional view of FIG. 3. FIG. 5 is a cross-sectional view of a frame and a discharge cover assembly according to an embodiment of the disclosure. FIG. 6 is an enlarged view a portion A of FIG. 5. FIG. 7 is a modified example of FIG. 6.

Referring to FIGS. 3 to 7, a compressor 100 according to an embodiment of the disclosure may include a discharge cover assembly 200, a frame 300, a cylinder 400, a piston 500, a discharge valve 600, an elastic member 700, a gas layer 800, and a loop pipe 900. However, the present disclosure can be implemented except some of the components and does not exclude additional components.

The compressor 100 may include the discharge cover assembly 200. The discharge cover assembly 200 may be disposed in front of the frame 300. The discharge cover assembly 200 may be disposed in front of the cylinder 400. The discharge cover assembly 200 may form a discharge space in which a refrigerant compressed and discharged inside the cylinder 400 flows. One end of the loop pipe 900 may be disposed in the discharge space of the discharge cover assembly 200. The refrigerant flowing in the discharge space of the discharge cover assembly 200 may flow in the loop pipe 900.

The discharge cover assembly 200 may be disposed in the frame 300. An outer surface of the discharge cover assembly 200 may be spaced apart from an inner surface of the frame 300. The gas layer 800 may be formed in a separation space between the outer surface of the discharge cover assembly 200 and the inner surface of the frame 300.

Referring to FIGS. 3 and 4, a temperature of the discharge space of the discharge cover assembly 200 is higher than the frame 300. The gas layer 800 with low thermal conductivity can minimize the efficiency of heat transfer to the frame 300 of a relatively low temperature generated by a high temperature and a high pressure gas of the discharge space. Hence, a reduction in compression efficiency can be prevented. In an embodiment of the disclosure, the gas layer 800 may be an air layer, but may be filled with another gas with low thermal conductivity.

The discharge cover assembly 200 may include a first discharge cover 210. The first discharge cover 210 may be disposed in the frame 300. The first discharge cover 210 may be disposed in front of the frame 300. The first discharge cover 210 may be disposed outside a second discharge cover 220. The first discharge cover 210 may be formed in a shape corresponding to a body portion 310 and a first flange portion 320 of the frame 300. The first discharge cover 210 may be spaced apart from an inner surface of the body portion 310 of the frame 300 and a first stepped portion 330. A separation space may be formed between an outer surface of the first discharge cover 210 and the inner surface of the frame 300. The gas layer 800 may be formed in the separation space between the outer surface of the first discharge cover 210 and the inner surface of the frame 300.

A first discharge space may be formed between the first discharge cover 210 and the discharge valve 600. The refrigerant discharged from the discharge valve 600 may flow in the first discharge space.

The first discharge cover 210 may include a body portion 212. The body portion 212 may form an appearance of the first discharge cover 210. The body portion 212 may be disposed in the frame 300. The body portion 212 may be disposed in the body portion 310 of the frame 300. The body portion 212 may contact the inner surface of the body portion 310 of the frame 300. An embodiment of the disclosure describes that the body portion 212 contacts the inner surface of the body portion 310 of the frame 300, and the gas layer 800 is formed between a bottom surface of a groove 214 of the first discharge cover 210 and the body portion 310 of the frame 300, by way of example. However, the gas layer 800 may be formed between an outer surface of the body portion 212 and the body portion 310 of the frame 300. In this case, since the area of the gas layer 800 increases, heat dissipation efficiency can be improved.

The first discharge cover 210 may include the groove 214. The groove 214 may be formed in the body portion 212. The groove 214 may be recessed inward from the outer surface of the body portion 212. The bottom surface of the groove 214 may be spaced apart from the inner surface of the body portion 310 of the frame 300. The gas layer 800 may be formed between the groove 214 and the body portion 310 of the frame 300. The gas layer 800 with low thermal conductivity can minimize the efficiency of heat transfer to the frame 300 of a relatively low temperature generated by a high temperature and a high pressure gas of the discharge space.

The first discharge cover 210 may include a partition wall 216. The partition wall 216 may be formed in the groove 214 of the first discharge cover 210. The partition wall 216 may extend from the groove 214 of the first discharge cover 210 in a radial direction. The partition wall 216 may be disposed in contact with or adjacent to the inner surface of the body portion 310 of the frame 300. The partition wall 216 may include a plurality of partition walls spaced apart in the axial direction. The elastic member 700 may be disposed between the plurality of partition walls. The partition wall 216 may be disposed in the rear of the body portion 212 and/or the groove 214. The partition wall 216 may be disposed in the rear of the gas layer 800 or the rear of the first discharge cover 210. Hence, the first discharge cover 210 can be stably fixed to the inside of the frame 300.

The first discharge cover 210 may include a second flange portion 218. The second flange portion 218 may be disposed in front of the body portion 212. The second flange portion 218 may be disposed in front of a second stepped portion 219. The second flange portion 218 may extend in a front area of the body portion 212 in the radial direction. The second flange portion 218 may extend in a front area of the second stepped portion 219 in the radial direction. A rear surface of the second flange portion 218 may be opposite to a front surface of the first flange portion 320. The second flange portion 218 may be fixed to the first flange portion 320. The second flange portion 218 may be disposed in a seating groove 340 of the first flange portion 320. The rear surface of the second flange portion 218 may contact a front end of a second parallel portion 830 of the gas layer 800. The rear surface of the second flange portion 218 may contact a front area of a second vertical portion 840 of the gas layer 800.

The first discharge cover 210 may include the second stepped portion 219. The second stepped portion 219 may be disposed in front of the body portion 212. The second stepped portion 219 may protrude outward or in the radial direction from the front area of the body portion 212. The second stepped portion 219 may be disposed between the body portion 212 and the second flange portion 218. The second stepped portion 219 may be spaced apart from the frame 300. The second stepped portion 219 may be spaced apart from the first stepped portion 330 of the frame 300. The gas layer 800 may be formed between the second stepped portion 219 and the first stepped portion 330 of the frame 300. A first vertical portion 820 and the second parallel portion 830 of the gas layer 800 may be formed between the second stepped portion 219 and the first stepped portion 330 of the frame 300. Hence, since the area of the gas layer 800 can be improved, an insulating effect can be improved.

The discharge cover assembly 200 may include the second discharge cover 220. The second discharge cover 220 may be disposed in the first discharge cover 210. A second discharge space may be formed between the second discharge cover 220 and the first discharge cover 210. The refrigerant passing through the first discharge space may flow in the second discharge space.

The discharge cover assembly 200 may include a third discharge cover 230. The third discharge cover 230 may be disposed in the first discharge cover 210. The third discharge cover 230 may be disposed in front of the second discharge cover 220. A third discharge space may be formed between the third discharge cover 230, the first discharge cover 210, and the second discharge cover 220. The refrigerant passing through the second discharge space may flow in the third discharge space.

The discharge cover assembly 200 may include a fourth discharge cover 240. The fourth discharge cover 240 may be disposed in front of the first discharge cover 210. The fourth discharge cover 240 may be disposed in front of the third discharge cover 230. A fourth discharge space may be formed between the fourth discharge cover 240, the first discharge cover 210, and the third discharge cover 230. The refrigerant passing through the third discharge space may flow in the fourth discharge space. The loop pipe 900 may be disposed in the fourth discharge space. The refrigerant flowing in the fourth discharge space may be discharged to the outside of the discharge space through the loop pipe 900.

The fourth discharge cover 240 may include a third flange portion disposed in front of the second flange portion 218. The third flange portion of the fourth discharge cover 240 may be fixed to the first flange portion 320 together with the second flange portion 218 through a fastening member such as a bolt.

An embodiment of the disclosure describes that the discharge cover assembly 200 includes the four discharge covers, by way of example. However, if two or more discharge covers are used, the number of discharge covers may be variously changed.

The compressor 100 may include the frame 300. The frame 300 may support the cylinder 400. The cylinder 400 may be disposed in the frame 300. The discharge cover assembly 200 may be disposed in the frame 300. The frame 300 may be formed in a cylindrical shape. The gas layer 800 may be formed between the frame 300 and the discharge cover assembly 200. The gas layer 800 with low thermal conductivity can minimize the efficiency of heat transfer to the frame 300 of a relatively low temperature generated by a high temperature and a high pressure gas of the discharge space.

The frame 300 may include the body portion 310. The body portion 310 may form an appearance of the frame 300. The body portion 310 may be formed in a cylindrical shape. The body portion 310 may be formed to extend in the axial direction. The cylinder 400 may be disposed in the body portion 310. The piston 500 may be disposed in the body portion 310. The discharge valve 600 may be disposed in the body portion 310. The discharge cover assembly 200 may be disposed in the body portion 310. The first discharge cover 210 may be disposed in the body portion 310. The body portion 212 of the first discharge cover 210 may be disposed in the body portion 310.

The inner surface of the body portion 310 may be spaced apart from the outer surface of the discharge cover assembly 200. The inner surface of the body portion 310 may be spaced apart from the outer surface of the first discharge cover 210. The inner surface of the body portion 310 may be spaced apart from the bottom surface of the groove 214 of the first discharge cover 210. The gas layer 800 may be formed in a space between the inner surface of the body portion 310 and the bottom surface of the groove 214 of the first discharge cover 210.

The frame 300 may include the first flange portion 320. The first flange portion 320 may be formed in the front area of the body portion 310. The first flange portion 320 may extend from the body portion 310 in the radial direction. The second flange portion 218 of the first discharge cover 210 may be disposed in front of the first flange portion 320. The second flange portion 218 and the fourth discharge cover 240 may be fixed to the first flange portion 320 through a fastening member such as a screw.

The first flange portion 320 may include the seating groove 340. The seating groove 340 may be recessed rearward from the front surface of the first flange portion 320. The seating groove 340 may be formed in a shape corresponding to the second flange portion 218. The second flange portion 218 may be disposed in the seating groove 340. The seating groove 340 may be formed in front of the first stepped portion 330. The seating groove 340 may be formed in a circular band shape.

The frame 300 may include the first stepped portion 330. The first stepped portion 330 may be disposed in front of the body portion 310. The first stepped portion 330 may be disposed between the first flange portion 320 and the body portion 310. The first stepped portion 330 may be disposed on the first flange portion 320. The first stepped portion 330 may be formed on the inner surface of the first flange portion 320. The first stepped portion 330 may be recessed outwards from the inner surface of the first flange portion 320. The first stepped portion 330 may be formed in a shape corresponding to the second stepped portion 219. The first stepped portion 330 may be spaced apart from the second stepped portion 219. The gas layer 800 may be formed in a separation space between the first stepped portion 330 and the second stepped portion 219. The first vertical portion 820 and the second parallel portion 830 of the gas layer 800 may be disposed in the separation space between the first stepped portion 330 and the second stepped portion 219. Hence, the area of the gas layer 800 can increase, and an insulating effect can be improved.

Referring to FIG. 7, the first flange portion 320 may include a gas groove 350. The gas groove 350 may be recessed inward from the outer surface of the first flange portion 320. The gas groove 350 may be formed between the first flange portion 320 and the second flange portion 218 of the first discharge cover 210. The gas groove 350 may be disposed in the rear of the seating groove 340. The gas groove 350 may be disposed in the rear of the second flange portion 218 of the first discharge cover 210. The gas groove 350 may extend in the radial direction. The gas layer 800 may be formed in the gas groove 350. The second vertical portion 840 of the gas layer 800 may be formed in the gas groove 350. One end of the gas groove 350 may communicate with the second parallel portion 830 of the gas layer 800, and the other end may be exposed to the outside. Hence, since an external gas of a relatively low temperature flows through the gas layer 800, heat transfer between the discharge space and the frame 300 can be minimized.

The compressor 100 may include the cylinder 400. The cylinder 400 may be disposed in the frame 300. The cylinder 400 may be supported by the frame 300. The cylinder 400 may be supported by the body portion 310 of the frame 300. The piston 500 may be disposed in the cylinder 400.

The compressor 100 may include the piston 500. The piston 500 may be disposed in the cylinder 400. The piston 500 may linearly reciprocate in the cylinder 400 in the axial direction.

The compressor 100 may include a discharge valve 600. The discharge valve 600 may be disposed on the piston 500. The discharge valve 600 may be disposed in front of the piston 500. The discharge valve 600 may selectively discharge the refrigerant in the piston 500. For example, during the compression stroke, the discharge valve 600 may discharge the compressed refrigerant in the piston 500.

The compressor 100 may include the elastic member 700. The elastic member 700 may be disposed between the discharge cover assembly 200 and the frame 300. The elastic member 700 may be disposed between the plurality of partition walls 216 of the first discharge cover 210. The elastic member 700 may be disposed in the rear of the gas layer 800. The elastic member 700 may be formed in a circular band shape. The elastic member 700 may fix the discharge cover assembly 200 to the inside of the frame 300. The elastic member 700 may be referred to as a 'pressing ring'.

The compressor 100 may include the gas layer 800. The gas layer 800 may be disposed in front of the cylinder 400. The gas layer 800 may be disposed in front of the piston 500. The gas layer 800 may be disposed between the groove 214 and the frame 300. The gas layer 800 may extend in the axial direction. The gas layer 800 may not overlap the discharge valve 600 in the radial direction. The gas layer 800 may not overlap the piston 500 in the axial direction. In an embodiment of the disclosure, the gas layer 800 is described as being formed between the groove 214 and the inner surface of the frame 300, by way of example. However, the gas layer 800 may be formed between the outer surface of the body portion 212 and the inner surface of the frame 300.

The gas layer 800 may include the first parallel portion 810. The first parallel portion 810 may extend in the axial direction. An axial length of the first parallel portion 810 may be greater than an axial length of the second parallel portion 830. The first parallel portion 810 may be formed in front of the partition wall 216. The first parallel portion 810 may be formed in the rear of the first vertical portion 820.

The gas layer 800 may include the first vertical portion 820. The first vertical portion 820 may be disposed in front of the first parallel portion 810. The first vertical portion 820 may extend from the front of the first parallel portion 810 in the radial direction. The first vertical portion 820 may be formed between the first stepped portion 330 and the second stepped portion 219. A size of the first vertical portion 820 may be less than a size of the second vertical portion 840.

The gas layer 800 may include the second parallel portion 830. The second parallel portion 830 may be disposed outside the first vertical portion 820. The second parallel portion 830 may extend forward from the outside of the first vertical portion 820. The front end of the second parallel portion 830 may contact the rear surface of the second flange portion 218. The front end of the second parallel portion 830 may contact the bottom surface of the seating groove 340. An axial length of the second parallel portion 830 may be less than an axial length of the first parallel portion 810. The second parallel portion 830 may be formed between the first stepped portion 330 and the second stepped portion 219. The second parallel portion 830 may be connected to the second vertical portion 840.

The gas layer 800 may include the second vertical portion 840. The second vertical portion 840 may be disposed in front of the second parallel portion 830. The second vertical portion 840 may extend from the front end of the second parallel portion 830 in the radial direction. The second vertical portion 840 may be exposed externally or to the outside through the gas groove 350. The radial length of the second vertical portion 840 may be greater than the radial length of the first vertical portion 820. The front area of the second vertical portion 840 may contact the rear surface of the second flange portion 218.

The compressor 100 may include the loop pipe 900. The loop pipe 900 may be disposed in the discharge cover assembly 200. The loop pipe 900 may be disposed in the discharge space. One end of the loop pipe 900 may be disposed in the fourth discharge space, and the other end may be disposed outside the discharge cover assembly 200. The refrigerant flowing in the discharge space may be discharged out of the discharge space through the loop pipe 900.

Figure 8:
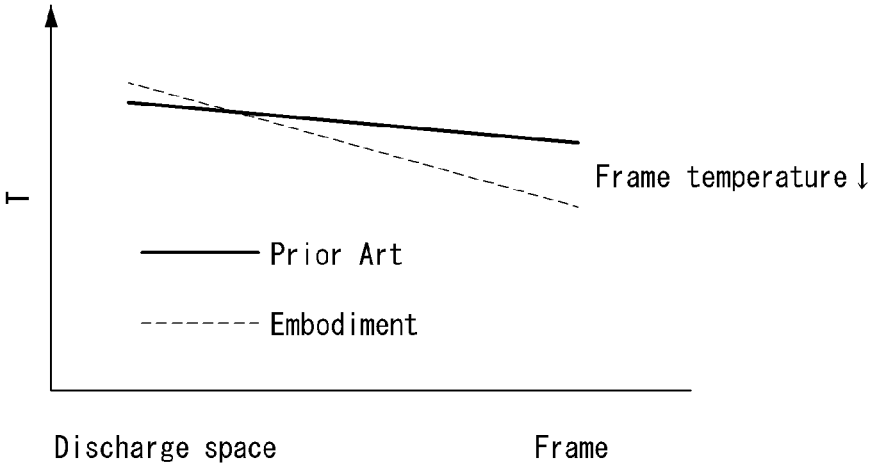
FIG. 8 is a graph illustrating heat transfer of a compressor according to an embodiment of the disclosure.

FIG. 8 is a graph illustrating heat transfer of a compressor according to an embodiment of the disclosure.

Referring to FIGS. 4-8, the front of the piston 500 and the discharge space of the discharge cover assembly 200 inside the compressor 100 have the highest temperature. That is, in an embodiment of the disclosure, the formation of the gas layer 800 can minimize heat transfer to the frame 300 of a relatively low temperature generated as a high temperature and high pressure gas flowing in the discharge space acts as a heat source. Hence, an embodiment of the disclosure can prevent a heat loss and improve compression efficiency.

Some embodiments or other embodiments of the disclosure described above are not exclusive or distinct from each other. Some embodiments or other embodiments of the disclosure described above can be used together or combined in configuration or function.

For example, a configuration "A" described in an embodiment and/or the drawings and a configuration "B" described in another embodiment and/or the drawings can be combined with each other. That is, although the combination between the configurations is not directly described, the combination is possible except if it is described that the combination is impossible.

The above detailed description is merely an example and is not to be considered as limiting the present disclosure. The scope of the present disclosure should be determined by rational interpretation of the appended claims, and all variations within the equivalent scope of the present disclosure are included in the scope of the present disclosure.

What is claimed is:

1. A compressor comprising:

a cylinder configured to receive refrigerant therein;

a frame that supports the cylinder; and a discharge cover assembly that is disposed at a front of the frame, wherein a gas layer is defined between the discharge cover assembly and the frame and extends along an axial direction, wherein the gas layer is disposed radially outside the discharge cover assembly, wherein the frame comprises:

a first body portion that supports the cylinder, and a first flange portion that extends from the first body portion in a radial direction of the cylinder, wherein the first flange portion comprises a first stepped portion defined at an inner surface of the first flange portion, wherein the discharge cover assembly comprises a first discharge cover that faces the first body portion and the first flange portion, that is disposed in the first body portion, and that is spaced apart from each of an inner surface of the first body portion and the first stepped portion, and wherein the first discharge cover, the first body portion, and the first flange portion are arranged to define a plurality of portions of the gas layer that comprise:

a first parallel portion that extends along the axial direction, a first vertical portion that extends from a front end of the first parallel portion in the radial direction of the cylinder, and a second parallel portion that extends forward from a radially outside end of the first vertical portion to the first discharge cover.

2. The compressor of claim 1, wherein the gas layer is disposed radially inside the frame.

3. The compressor of claim 1, wherein the discharge cover assembly comprises:

a second discharge cover disposed in the first discharge cover;

a third discharge cover disposed forward relative to the second discharge cover; and a fourth discharge cover disposed forward relative to the first discharge cover, the second discharge cover, and the third discharge cover.

4. The compressor of claim 1, wherein the first discharge cover comprises a plurality of partition walls that extend in the radial direction to the inner surface of the first body portion and that are spaced apart from one another in the axial direction.

5. The compressor of claim 4, further comprising an elastic member disposed between the plurality of partition walls.

6. The compressor of claim 4, wherein the plurality of partition walls extend from a rear area of the first discharge cover in the radial direction.

7. The compressor of claim 1, wherein the first flange portion defines a gas groove at a front surface of the first flange portion, and wherein the plurality of portions of the gas layer further comprise a second vertical portion that extends from the second parallel portion along the gas groove and that is exposed to an outside of the frame.

8. The compressor of claim 7, wherein a radial length of the second vertical portion is greater than a radial length of the first vertical portion.

9. The compressor of claim 1, wherein the first discharge cover comprises:

a second body portion disposed in the first body portion of the frame;

a second stepped portion disposed forward relative to the second body portion; and a second flange portion that extends from a front end of the second stepped portion in the radial direction.

10. The compressor of claim 9, wherein a rear surface of the second flange portion defines a front end of the second parallel portion.

11. The compressor of claim 9, wherein the first flange portion defines a seating groove that is recessed rearward from a front surface of the first flange portion and that receives the second flange portion.

12. The compressor of claim 11, wherein the first flange portion defines a gas groove at the front surface of the first flange portion, wherein the plurality of portions of the gas layer further comprise a second vertical portion that extends from the second parallel portion along the gas groove and that is exposed to an outside of the frame, and wherein a rear surface of the second flange portion contacts a front side of the second vertical portion.

13. The compressor of claim 1, wherein an axial length of the first parallel portion is greater than an axial length of the second parallel portion.

14. The compressor of claim 1, wherein the first discharge cover defines a groove at an outer circumferential surface of the first body portion of the frame, and wherein the gas layer is defined between the groove and the frame.

15. The compressor of claim 1, wherein the gas layer is defined forward relative to the cylinder.

16. The compressor of claim 1, further comprising:

a piston disposed in the cylinder and configured to compress the refrigerant in the cylinder; and a discharge valve disposed at a front end of the piston and configured to discharge compressed refrigerant toward the discharge cover assembly.

17. The compressor of claim 16, wherein the gas layer is disposed radially outside of the discharge valve.

18. The compressor of claim 16, wherein the gas layer is spaced apart from the piston in the axial direction.

* * * * *